United States Patent [19]

Crane et al.

[11] Patent Number: 4,657,188

[45] Date of Patent: Apr. 14, 1987

[54] SPRAY SYSTEM FOR A DISHWASHING MACHINE

[75] Inventors: Herbert R. Crane, Kenton; Richard D. Valentine, Pleasant Hill, both of Ohio

[73] Assignee: Hobart Corporation, Troy, Ohio

[21] Appl. No.: 651,204

[22] Filed: Sep. 17, 1984

[51] Int. Cl.[4] ..... B05B 1/14; B05B 1/00; B08B 3/00; F16L 35/00

[52] U.S. Cl. ..... 239/557; 239/565; 239/600; 134/59; 134/72; 285/24; 285/31

[58] Field of Search ..... 239/556, 557, 565, 600; 285/24–29, 31, 282, 283; 134/59, 72, 131, 200

[56] References Cited

U.S. PATENT DOCUMENTS

| | | | |
|---|---|---|---|
| 3,013,788 | 12/1961 | Hajek et al. | 285/28 X |
| 3,279,828 | 10/1966 | MacFarland | 285/283 X |
| 4,011,997 | 3/1977 | Klimas | 239/556 |
| 4,257,559 | 3/1981 | Noren | 239/566 X |

*Primary Examiner*—Joseph F. Peters, Jr.
*Assistant Examiner*—Patrick N. Burkhart
*Attorney, Agent, or Firm*—Biebel, French & Nauman

[57] ABSTRACT

A spray system is disclosed for forming directed streams of liquid under pressure. A supply conduit having an open end and a manifold communicating with a plurality of spray nozzles and having an inlet conduit with an open end cooperate for insertion of the inlet conduit into the supply conduit to connect the manifold to the supply conduit, the manifold is placed near the supply conduit in a predetermined but misaligned position. A plate having a slot defines at least a portion of a pair of cam surfaces and a wash arm formed on the manifold defines a cam follower. Rotation of the inlet conduit about its central axis causes the cam follower to contact and cooperate with the cam surfaces to produce lateral force along the inlet conduit, thereby forcing the same into fluid-tight engagement with the supply conduit. Alternatively, a pin and a cooperating opening may be provided, so that placement of the pin within the opening enables pivotal motion of the inlet conduit for moving the same into engagement with the supply conduit.

8 Claims, 10 Drawing Figures

SPRAY SYSTEM FOR A DISHWASHING MACHINE

BACKGROUND OF THE INVENTION

The present invention relates generally to a spray system for a dishwashing machine, and more particularly, to such a system that includes a spray manifold that can be easily removed for cleaning and then easily replaced.

Dishwashing machines fall into two generally distinct but somewhat overlapping categories, namely, domestic or home machines, and commercial machines such as are used in restaurants, institutions or other public facilities. This latter category is itself divisible into various types of commercial machines.

Two of the most common types of commercial machines are the single rack-type and the conveyor-type. The former includes a single chamber into which a rack of soiled ware can be placed. Within the chamber, the entire cleaning process including washing, rinsing and drying is performed on the rack. Multiple racks must be washed sequentially, with each rack being completely cleaned before the next can be operated upon.

Conveyor-type machines, on the other hand, include a conveyor for carrying racks of ware through multiple stations within the machine. A different operation is carried out at each station, such as washing, rinsing, or drying. Thus, multiple racks of ware can be placed on the conveyor and moved continuously through the machine so that, for example, while one rack is being rinsed, a succeeding rack can be dried.

Examples of both of these types of commercial dishwashing machines can be found in U.S. Pat. No. 4,439,242, issued Mar. 27, 1984 to Hadden.

Of course, any dishwasher must thoroughly clean and sanitize the ware upon which it operates. To this end, an organization called the National Sanitation Foundation (NSF) was formed in the late 1940's. One of its functions is to provide minimum standards for commecial dishwashing machines to assure that ware has been adequately cleansed and sanitized.

While NSF standards are theoretically voluntary, public health and sanitation officials in the United States are believed to rely heavily upon them. A manufacturer is permitted to place an NSF label on the equipment to show that its design, manufacture and operation meet all of the minimum NSF standards for that particular type of equipment. Many sanitation officials will not permit installation or use of commercial dishwashing machines within their jurisdiction unless the machines have NSF labels, indicating that they are "listed" as being recognized by NSF. In effect, NSF standards are so well accepted that very few commercial dishwashing machines are sold in the United States without NSF listing.

A typical dishwashwer operates to clean ware by directing pressurized streams of heated water against the ware. Thus, a pumping system is generally provided that directs the water into a spray system having a plurality of nozzles for forming the pressurized streams. The particular construction of the spray system is dependent upon the type of machine, and in the case of a conveyor-type commercial machine, the spray system is disposed above and below the conveyor path. In a typical configuration, one or more fluid conduits extend from a spray manifold across the path in a generally transverse orientation above or below the conveyor.

More than one such manifold is usually provided, with various ones thereof dedicated to washing, rinsing, or the like.

Since most dishwashers recycle water through the spray system (other than rinse water, which is fresh), wash water that has previously been in contact with soiled ware is circulated through the spray system. Although larger soil is typically screened or filtered, some smaller soil particles and other debris can pass through the system, and present at least the potential for accumulation within the spray manifold. This not only represents an unsanitary condition, but can cause plugging of spray nozzles or interference with the water flow, thereby reducing the pressure or amount of water reaching the ware.

This problem has been recognized by, among others, the NSF. In its Standard No. 3 for Commercial Spray-Type Dishwashing Machines, NSF has provided in Section 4.12 as follows:

> "Spray Arms: Spray arms or similar devices shall be readily removable and easily cleanable, or easily cleanable in place . . . Spray arms or similar devices shall be designed and constructed to assure their reassembly in proper alignment."

Dishwasher manufacturers have followed this standard in designing and constructing conveyor-type machines. Moreover, many local health regulations specifically require the cleaning of spray arms at predetermined periodic intervals.

Despite the need to remove the spray manifolds for cleaning with relative frequency, such removal and the subsequent reinstallation has been a relatively tedious process. Typically, doorways are provided along the forward side of a conveyor-type machine to give access to the wash and rinse chamber interiors. However, to give such access to the chambers and to other components such as drains, screens and the like, the water supply conduits to the spray manifolds should preferably be placed at the back side of the machine. Accordingly, the connection of a manifold to its supply conduit must also be placed at the back of the machine, where it is almost impossible for the machine operator to reach the typical type of quick-connect/disconnect attachment means. Thus, if the supply is located remote from operator accessability, it is necessary to provide a coupling and uncoupling system which can be operated from a remote position without the use of tools.

One possible solution to this problem is proposed in U.S. Pat. No. 4,257,559, issued Mar. 24, 1981 to Noren. A spray manifold is provided that consists of a single cylindrical tube having a plurality of spray nozzles formed along the tube. At the rear side of the machine, a conical outlet is connected to the water supply conduit, so that the cylindrical manifold is placed over the conical outlet to form a fluid connection. At the front side of the machine, a threaded stud having a cap member attached thereto is engaged with the machine. The cap includes a sealing means, so that when the manifold is placed upon the conical outlet at the rear side of the machine, the cap can be placed on or adjacent to the opposite end of the manifold. Rotation of the cap causes the stud to force the cap into engagement with the manifold, thereby securing it in place and providing a fluid seal at each end. The manifold also includes a pin that cooperates with a plate having a slot attached to the conical outlet. Thus, by engaging the pin with the slot, proper orientation of the manifold is ensured.

While the Noren spray system enables the operator to remove the spray manifold from the forward side of the machine, it possesses several disadvantages in removing and reinstalling the manifolds. First, the construction inherently permits only single tube manifolds. While several different manifolds are typically required for different functions and stations within the machine, adequate spray coverage will frequently require multiple conduits to form a single spray system. (See for example the Hadden patent noted above.) These multiple conduits are typically interconnected to form a single manifold, so that the number of connect/disconnect operations that must be performed is kept relatively low. Unfortunately, multi-conduit manifolds are not practical with the Noren structure.

In addition, removal and installation of the manifold of Noren requires rotation of the cap to release or secure the manifold. Since the interior of the wash chamber will typically be wet, as well as the operator's hand, adequate gripping of the cap to enable its release or tightening may be quite difficult.

What is needed, therefore, is a spray manifold structure that enables easy removal and reinstallation within a commercial conveyor-type dishwashing machine so that the manifolds can be easily cleaned. Such a construction should enable relatively large manifolds to be manipulated, and should permit removal and installation from the forward side of the machine. At the same time, however, such a structure should not render the manifolds and/or the securing and sealing apparatus unduly complex.

SUMMARY OF THE INVENTION

The foregoing needs are met by the present invention, which provides a spray system for use in a dishwashing machine that includes spray manifolds which are easily removed and reinstalled. The spray system, which directs a liquid supplied under pressure from a liquid source, includes a supply conduit connected with the source and terminating at an open end. A manifold in communication with a plurality of spray nozzles includes an inlet conduit terminating at an open end. The supply and inlet conduits cooperate for insertion of the open end of the inlet conduit into the open end of the supply conduit. A sealing means is carried at the open end of at least one of the supply and inlet conduits for providing a fluid-tight seal upon proper alignment and full coupling of the inlet conduit with the supply conduit.

A first means is fixedly mounted with respect to one of the supply conduit and the manifold, while a second means is fixedly mounted with respect to the other. The first and second means cooperate such that upon guiding and positioning the open end of the inlet conduit near the open end of the supply conduit with the inlet conduit into a predetermined but misaligned position with respect to the supply conduit, the first and second means define a pivot about which the inlet conduit is moved into alignment with the supply conduit. Means for converting the pivotal motion of the inlet conduit into motion of its open end substantially along the central axis of the supply conduit moves the open end of the inlet conduit into fluid-tight engagement with the supply conduit.

According to one embodiment of the invention, the first means includes the inlet conduit and the second means includes a supporting means for supporting the inlet conduit for pivotal rotation about its axis. The predetermined misaligned position is defined by rotational misalignment of the inlet conduit while its axis and that of the supply conduit are colinear. The pivotal converting means includes third and fourth means.

The third means defines a pair of opposing first and second cam surfaces, and the fourth means defines a cam follower for cooperation with the cam surfaces. One of the third and fourth means is fixedly mounted with respect to the supply conduit, and the other means is fixedly mounted with respect to the inlet conduit. The cam surfaces and cam follower are defined such that upon positioning of the open end of the inlet conduit adjacent to the open end of the supply conduit in approximately the predeterminerd misaligned positions, and upon positioning of the cam follower adjacent the first cam surface, rotation of the inlet conduit about its central axis causes movement of the cam follower along the first cam surface. This movement produces lateral movement of the inlet conduit along its axis to move the open end thereof into fluid-tight engagement with the open end of the supply conduit. Removal of the manifold is achieved by essentially a reverse operation, but with the cam follower moving along the second cam surface.

The first means may include a plate having a slot with opposing side edges formed therein, the side edges defining the first and second cam surfaces. The manifold may include a spray arm extending subtantially perpendicularly from the inlet conduit and having the spray nozzles formed thereon. The spray arm is formed of a diameter such that the arm is fittable within the slot of the plate, and the spray arm thus serves as the cam follower.

In an alternative embodiment, the predetermined misaligned position is defined by the axes of the supply and inlet conduits, which are in a generally planar relationship but define an angle therebetween. The pivotal converting means includes the first and second means. Rather than utilizing cam surfaces and a cam follower, the first means defines a pin and the second means defines an opening for receiving the pin. Tne first and second means are further mounted with respect to the supply and inlet conduits such that upon guiding and placement of the pin into the opening, the inlet conduit is located in approximately the predetermined misaligned position. Pivotal movement of the manifold about the pin in a direction to align the conduits causes insertion of the open end of the inlet conduit into the open end of the supply conduit to form a fluid-tight seal therebetween. Disengagement of the conduits is effected by a reverse operation.

The first means may include first and second plates disposed substantially in parallel with a cylindrical pin connected therebetween. The second means may include a third plate having a slot defined therein, the pin being insertable into the slot. The first and second plates are mounted to one of the inlet and supply conduits near its open end, and the third plate is mounted to the other of the conduits near its open end.

Accordingly, it is an object of the present invention to provide a spray system for a dishwashing machine having spray manifolds that are easily removed for cleaning and then reinstalled; to provide such a system in which relatively large manifolds can be easily manipulated; to provide such a system in which the manifolds can be easily removed and installed from the forward side of the machine without the use of tools; to provide such a system in which the manifolds can be removed and installed in situations in which the operator cannot see the actual decoupling or coupling of the manifolds; to provide such a system in which the manifolds cannot be engaged improperly; and to provide such a system in which the supply system is relatively simple and inexpensive to manufacture.

Other objects and advantages of the present invention will be apparent from the following description, the accompanying drawings, and the appended claims.

DETAILED DESCRIPTION OF PREFERRED EMBODIMENTS

Figure 1:
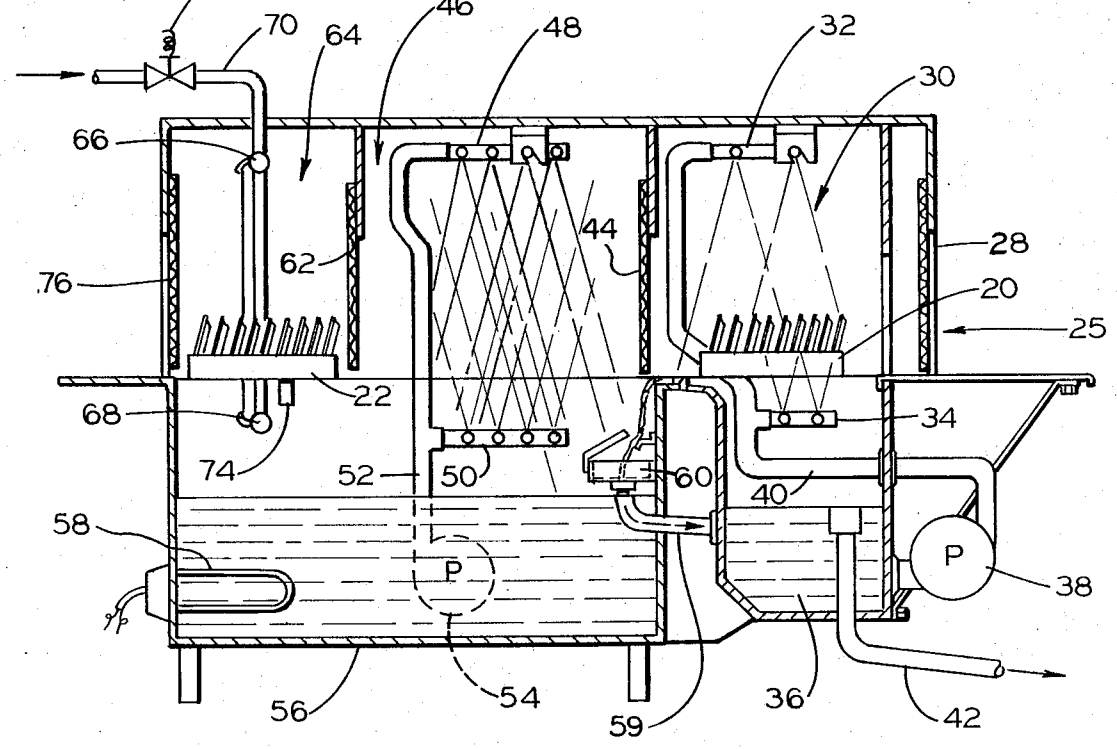
FIG. 1 is a side sectional view of a dishwashing machine of the conveyor type with which the spray system of the present invention may be used.

Referring now to the drawings, FIG. 1 illustrates a model of a conveyor-type dishwashing machine to which the present invention is applicable. In such a machine, which is shown from the forward or operator side, racks of soiled ware, shown generally at 20 and 22, are moved through tunnel-like chambers within the machine from an entrance end to an exit end, by a suitable conveyor mechanism which is shown schematically by arrow 25. Either continuously or intermittently moving conveyor mechanisms may be used, depending upon the style, model, and size of the machine. The racks of soiled ware enter the machine through a flexible curtain 28 into a prewash chamber 30, where sprays of liquid from upper and lower pre-wash manifolds 32 and 34 above and below the racks, respectively, function to flush heavier soil from the ware. The liquid for this purpose comes from a tank 36 via a pump 38 and supply conduit 40, and the level in this tank is maintained by a standpipe 42 that overflows to drain.

The racks proceed through the next curtain 44 into the main wash chamber 46, where the ware is subjected to sprays of cleansing liquid from upper and lower wash manifolds 48 and 50, respectively, these being supplied through supply conduit 52 by a pump 54 which draws from the main tank 56. A heater, shown as an electrical immersion heater 58 and provided with suitable thermostatic controls (not shown), maintains the temperature of the cleansing liquid at a suitable level. Not shown, but typically included, is a device for adding a cleansing detergent to the liquid in the tank 56, along with controls for this device that maintain the concentration of detergent within desired limits. Overflow from tank 56 exits via pipe 59 into the prewash liquid tank 36. Above the overflow pipe 59 is a small catch pan 60 which may be used to direct any splash of pre-wash liquid that passes under the curtain 44 down into the overflow 59 and back to tank 36. During normal operation of the machine, pumps 38 and 54 are continuously driven, usually by separate motors, once the machine is started and until the period of use of the machine is completed.

The machine may optionally include a power rinse chamber (not shown) that is substantially identical to main wash chamber 46. In such a case, racks of ware proceed from wash chamber 46 into the power rinse chamber, within which heated rinse water is sprayed onto the ware from upper and lower manifolds. Tank 56 is divided in such an instance into a rinse tank and a wash tank, from which the respective manifolds are separately supplied.

The racks of cleansed ware exit the main chamber 46 (or the power rinse chamber) through a curtain 62 into the final rinse chamber 64. This chamber is provided with upper and lower spray heads 66 and 68, respectively, that are supplied with a flow of fresh hot water via pipe 70, under the control of a solenoid operated valve 72. A rack detector 74 is actuated when a rack of ware is positioned in the chamber 64, and through suitable electrical controls the detector causes energization of the solenoid valve 72 to open and admit the hot rinse water to the spray heads 66 and 68. The fresh water then drains from the ware into tank 56. The rinsed racks of ware exit chamber 64 through curtain 76.

The machine shown in FIG. 1 further includes an access door (not shown) in the side wall of each chamber 30, 46 and 64 along the operator side of the machine. These doors enable access to each chamber interior, including the spray manifolds mounted therein. Supply conduits 40 and 52 extend upwardly from their respective tanks along the rearward side of the machine, so as not to interfere with the access provided by the doors.

The present invention is related to the manner in which the various spray manifolds are secured within a dishwashing machine such as that shown in FIG. 1. While the invention will be described in detail with respect to upper and lower wash manifolds 48 and 50, it is to be understood that the invention is equally applicable in a substantially identical manner to upper and lower prewash manifolds 32 and 34, as well as upper and lower power rinse manifolds when provided.

In general, the present invention is based upon the concept of providing a misaligned and non-connected position into which each manifold can be easily guided and placed from the forward side of the machine. The misalignment can be either planar or rotational, and the manifold is pivoted to swing it into proper operative position. The apparatus is constructed such that the pivotal movement causes not only proper alignment, but also connects the manifold to its respective supply conduit.

Figure 2:
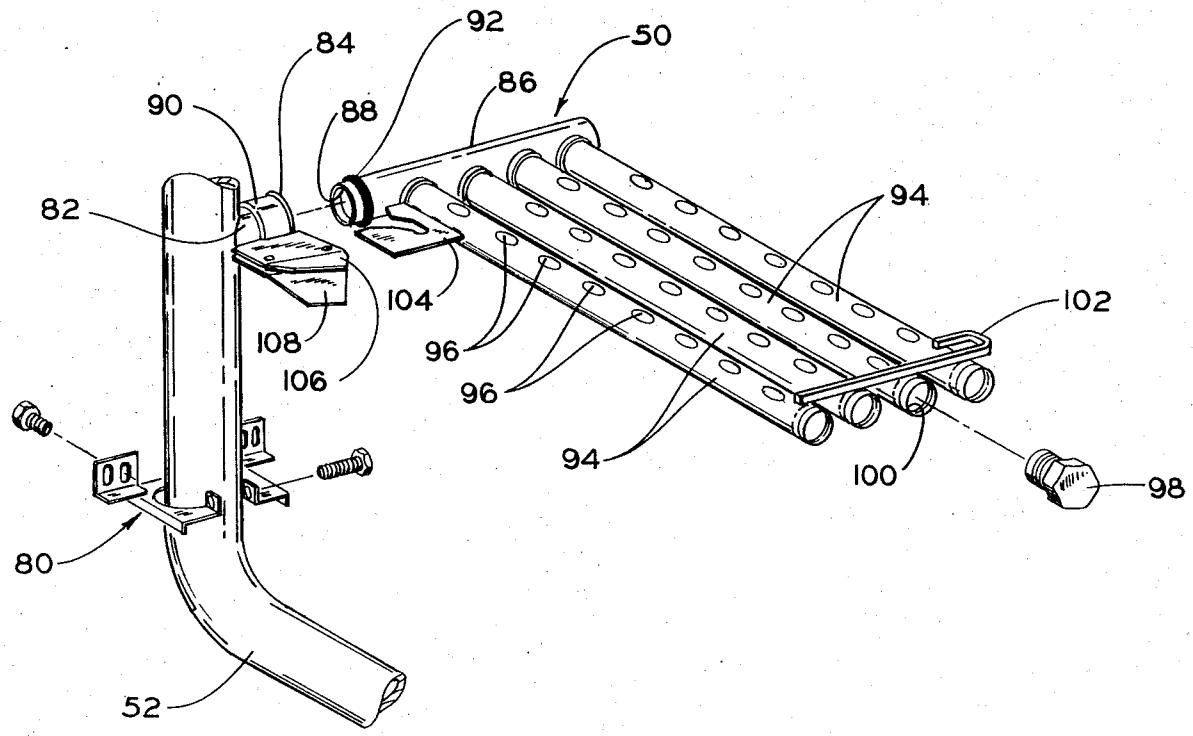
FIG. 2 is a perspective view showing a lower wash manifold and a portion of a supply conduit for use in the spray system, showing the manifold disconnected from the supply conduit.

The structure of lower wash manifold 50 can be seen by reference to FIG. 2. Manifold 50 connects with supply conduit 52 which is secured into the dishwasher wash chamber 46 by several brackets 80 (only one shown) or other appropriate mounting means. A branch conduit 82 extends from supply conduit 52 and terminates at an open end 84. Lower manifold 50 includes an inlet conduit 86 having an open end 88. Open end 88 of conduit 86 is fittable within open end 84 of branch conduit 82, which has a widened mouth 90 formed about open end 84. A sealing O-ring 92 is disposed within a groove about open end 88 of inlet conduit 86, so that upon insertion of open end 88 into open end 84, a fluid-tight seal is formed.

A plurality of wash arms 94 extend in parallel fashion from inlet conduit 86. Each wash arm 94 includes a number of spray nozzles 96 formed therealong so that water entering each wash arm 94 under pressure is directed upwardly through the nozzles 96. A cap 98 is insertable into the outer end 100 of each wash arm 94, and is preferably formed of a resilient material so that the cap 98 is effectively self-sealing. A J-shaped rod 102 is attached across the wash arms 94 near their outer ends by welding or the like, to provide greater structural stability for manifold 50 and to provide a portion of the means for supporting manifold 50 within wash chamber 46, as will be described below.

A plate 104 is secured to manifold 50 near the open end 88 of inlet conduit 86. Additional upper and lower plates 106 and 108, respectively, are attached to branch conduit 82 near its open end 84. Plates 104, 106, and 108 cooperate to provide interconnecting means for ensuring proper insertion of open end 88 into open end 84 to form a fluid-tight seal. The operation of this means will be described in detail below.

Figure 3:
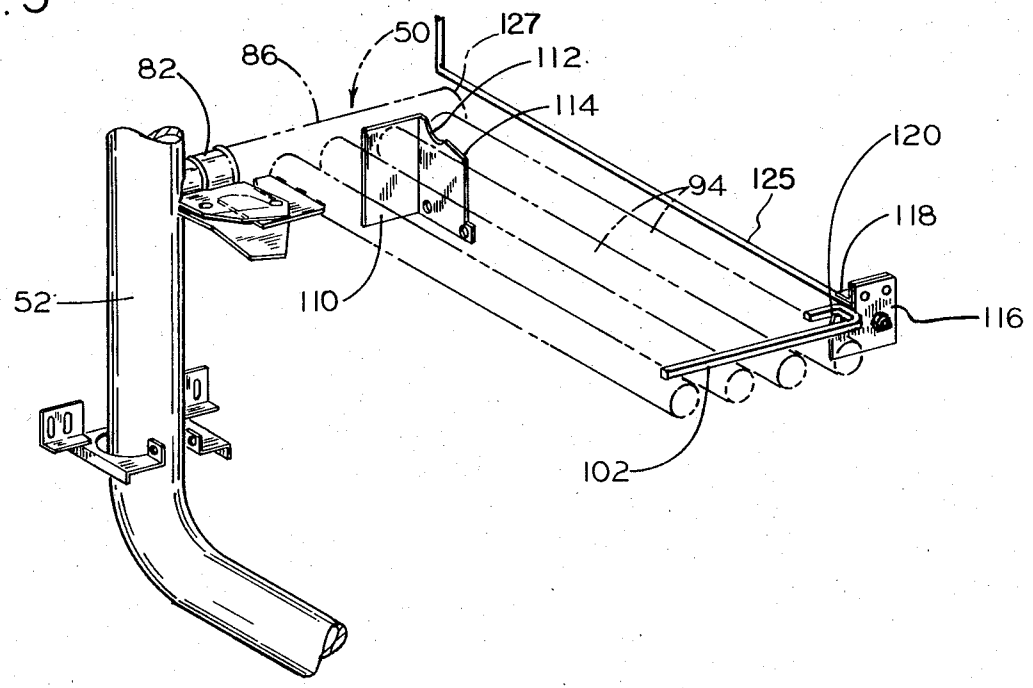
FIG. 3 is a view similar to FIG. 2, but showing the manifold connected to the supply conduit and in phantom to illustrate the supporting structure therefor.

The means by which manifold 50 is held in place within wash chamber 46 can be seen by reference to FIG. 3. The open end of inlet conduit 86 is secured within branch conduit 82 so as to form a fluid seal. A supporting plate 110 is mounted to the interior of wash chamber 46 by an appropriate combination of bolts, brackets and/or the like (not shown) to provide support at the opposite end of inlet conduit 86 of manifold 50. Plate 110 includes a curved supporting surface 112 that is of a radius of curvature substantially identical to the outer radius of conduit 86 so that when in place, conduit 86 is securely held on support surface 112. In addition, plate 110 includes a ramp surface 114 to facilitate proper engagement of conduit 86 with support surface 112 as manifold 50 is positioned within wash chamber 46.

The outer ends of wash arms 94 are supported by J-shaped rod 102. A latch plate 116 is secured by a bracket 118 to the interior of wash chamber 46. Once manifold 50 has been positioned within the wash chamber and inlet conduit 86 engaged with branch conduit 82, rod 102 is placed upon latch plate 116 as shown in FIG. 3. Despite engagement of conduit 86 with conduit 82, and formation of a fluid seal therebetween, sufficient play exists within such connection to enable rod 102 to be lifted over projection 118 on latch plate 116 for engagement of rod 102 therewith.

Figures 4, 5:
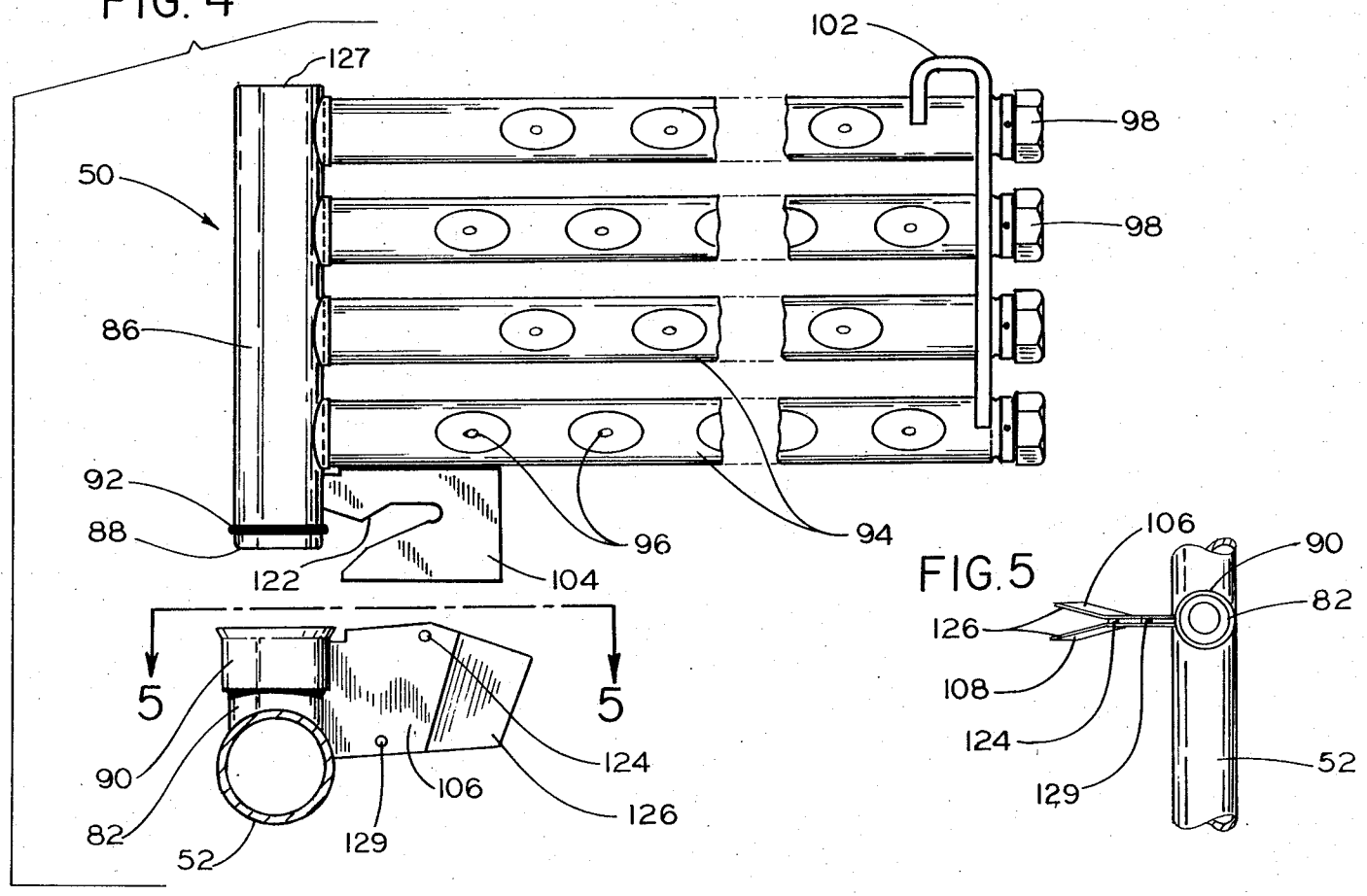
FIG. 4 is a top plan view of the lower wash manifold and a section taken through the supply conduit.
FIG. 5 is a reduced-size view taken generally along line 5—5 of FIG. 4.
Figure 6:
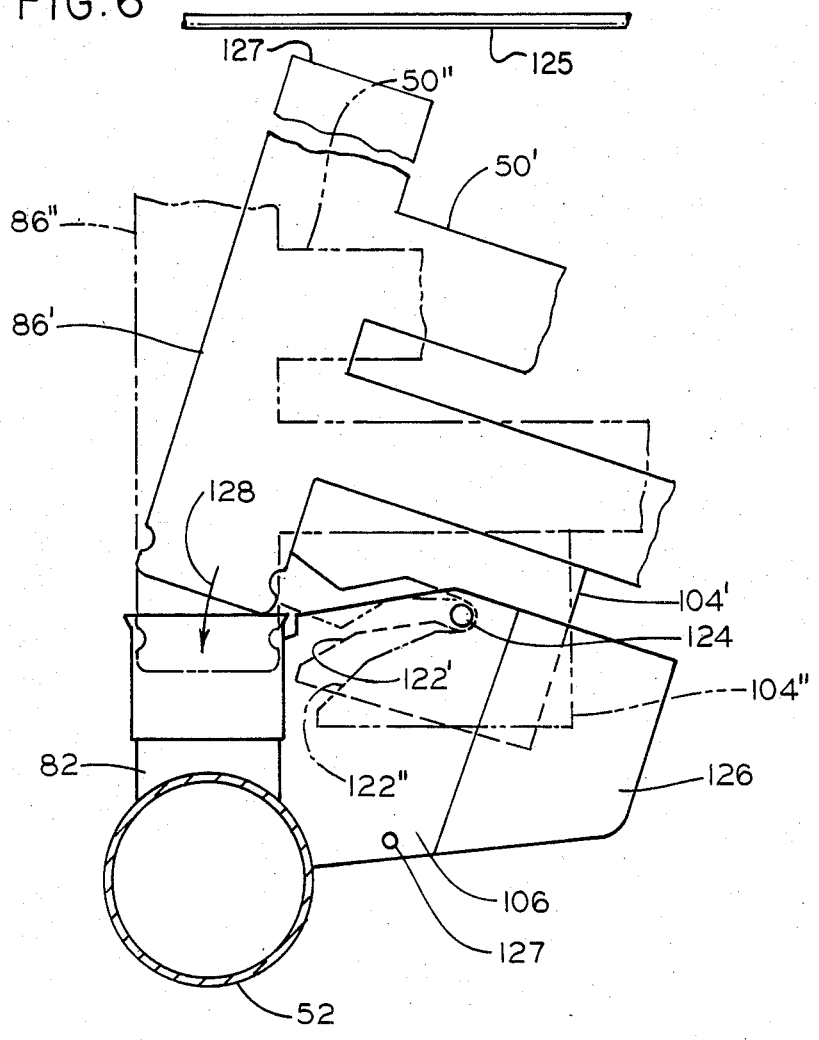
FIG. 6 is a top view of a portion of the manifold, illustrating the installation operation.

The structure of plates 104, 106 and 108, and their operation in ensuring a fluid-tight seal following connection of conduits 82 and 86, can be seen by reference to FIGS. 4, 5 and 6. As shown in FIG. 4, plate 104 is welded to conduit 86 near its open end 88 and defines therein a slot 122 opening toward open end 88 of conduit 86. Plates 106 and 108 have connected therebetween a pivot pin 124 and each includes an outward opening flange 126. In addition to pin 124, plates 106 and 108 are supported in their parallel relationship by support pin 129.

As seen in FIG. 6, securing of manifold 50 into wash chamber 46 is performed by guiding and inserting manifold 50 at approximately a predetermined angle of misalignment with respect to branch conduit 82. Manifold 50 is inserted at approximately proper horizontal alignment, and is manipulated so that plate 104, guided by flanges 126, enters the space between plates 106 and 108. As shown by manifold 50' in FIG. 6, insertion of manifold 50 at the predetermined angle of misalignment causes slot 122' in plate 104' to engage pin 124 extending between plates 106 and 108. Manifold 50' is moved until pin 124 reaches the bottom of slot 122', at which time manifold 50' is in the solid-line position indicated in FIG. 6. Geometrically, pin 124 at this point is perpendicular to but non-intersecting with the axis of inlet conduit 86.

Referring briefly back to FIG. 1, it can be seen that depending upon the details of the conveyor structure, door placement along the machine, and the like, it may be difficult if not impossible for the operator to see plates 104, 106 and 108 as they are engaged. In such an event, a guide means can be provided to facilitate installation of manifold 50. Preferably, such a guide means includes a horizontal surface on which manifold 50 is placed for sliding insertion into chamber 46 at the proper height for installation. A vertical guide, shown as rod 125 in FIG. 3, cooperates with the horizontal surface so that after the manifold 50 (or at least inlet conduit 86) is placed on the surface, the closed end 127 of inlet conduit 86 is placed against the vertical guide (see also FIG. 6). By positioning manifold 50 at approximately the predeteremined angle of misalignment and moving the manifold into wash chamber 46 with closed end 127 against the vertical guide, the operator can achieve engagement of plates 104, 106 and 108 while grasping the outer ends of wash arms 94 even if the engagement itself is not visible to the operator.

As a practical embodiment, the return portion of the conveyor itself may be suitable for use as the horizontal surface. This will depend, of course, upon the specific structure of the conveyor, but is preferred since no additional parts will need to be used. As an alternative, a plate or an open grid-like structure may be installed within the chamber 46 between the conveyor paths.

The vertical guide can be a plate, but more preferably can be the single rod 125 disposed transversely across chamber 46. Such a rod is relatively easy to fasten into place at each end, such as to plate 116 as shown, is relatively inexpensive, and yet is effective in guiding manifold 50 into place.

Referring again to FIG. 6, manifold 50 is moved as shown by manifold 50' into position by movement with closed end 127 against rod 125. As plate 104' enters between plate 106 and plate 108 (not seen), slot 122' begins to move about pin 124. However, plate 104' and slot 122' are configured such that pin 124 contacts the side edge of the slot. The edge performs a camming action in cooperation with pin 124 to shift manifold 50' laterally away from rod 125. This provides the necessary clearance between manifold 50' and rod 125 during subsequent pivotal movement of manifold 50'. A slight detent is formed in the slot ege near the base of slot 122' to hold pin 124 in relative position with respect to the slot edge.

Once pin 124 and slot 122 are fully engaged and manifold 50 is at the near-engagement position, manifold 50 is next pivoted about pin 124 to produce movement of inlet conduit 86' in the direction indicated by arrow 128 in FIG. 6. This forces conduit 86' into engagement with branch conduit 82, thereby forming the desired fluid seal. After insertion has been completed, manifold 50 is positioned as shown by manifold 50'' of FIG. 6.

As manifold 50 is being pivoted about pin 124, ramp surface 114 of plate 110 (see FIG. 3) forces inlet conduit 86 into engagement with support surface 112 of plate 110. Only after manifold 50 has been moved to its proper orientation, rod 102 can be engaged with latch 116, thereby securing manifold 50 within wash chamber 46.

For removal of manifold 50, the reverse steps of those described above are performed. Rod 102 is lifted slightly to free it from engagement witn latch 116. Manifold 50 is next pivoted about pin 124, so that inlet conduit 86 is moved from engagement with branch conduit 82. Once manifold 50 has been moved to approximately the misalignment shown by manifold 50' in FIG. 6, manifold 50 is simply moved outwardly from wash chamber 46.

It should be recognized from the foregoing description that manifold 50 can be placed into and removed from wash chamber 46 by an operator gripping manifold 50 along wash arms 94 near rod 102. Thus, full installation or removal can be performed in a reliable manner, so as to form a secure, fluid-tight seal, without the need for the operator to reach across wash chamber 46. At the same time, no manipulation of any fastening or sealing means is required other than movement of manifold 50. Further, the installation can be accomplished even if the operator cannot see the actual engagement, and importantly, the manifold 50 cannot be installed improperly.

Figure 7:
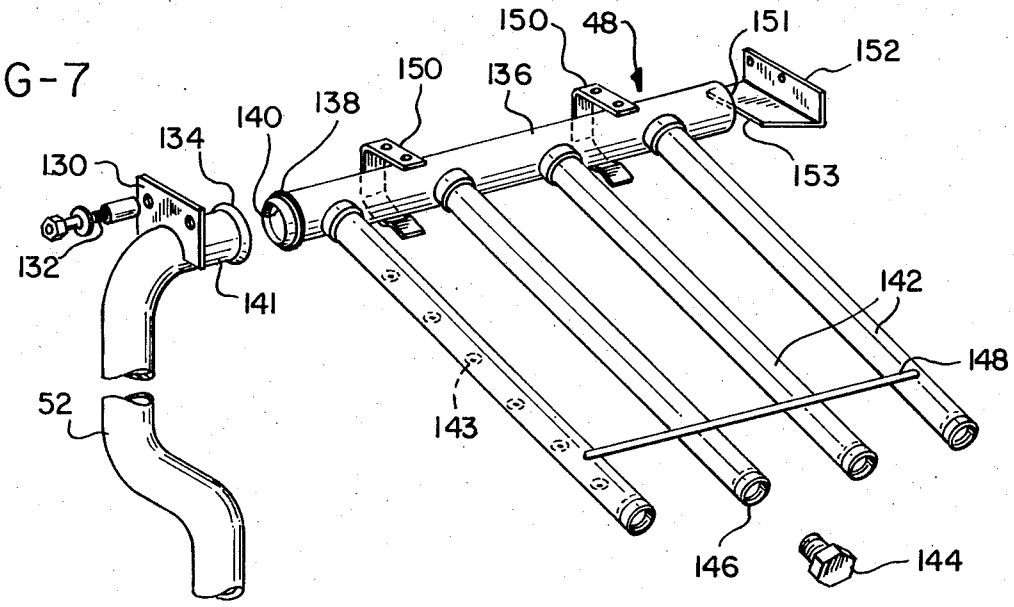
FIG. 7 is a perspective view showing an upper wash manifold and a portion of the supply conduit, showing the manifold in a mis-aligned but near-engagement position with respect to the conduit.

The upper wash manifold 48 can be seen in detail by reference to FIG. 7. It should be understood that the structure of manifold 48 is essentially the same as that of upper prewash manifold 32 and, where used, the upper power rinse manifold. Of course, it should be understood that the number of wash arms with which an upper manifold is equipped will not affect the manner in which the manifold is installed into the dishwahing machine.

Inlet conduit 52, which extends upwardly from tank 56, is provided with one or more brackets 130 and appropriate fastening means such as screws 132 for securing the conduit 52 to the interior of wash chamber 46.

Supply conduit 52 terminates at an open end 134 and is connectable thereat with inlet conduit 136 of manifold 48. Conduit 136 has a sealing O-ring 138 disposed within a groove around conduit 136 near open end 140. Open end 140 is insertable into a widened mouth 141 at open end 134 of supply conduit 52, and O-ring 138 provides a fluid-tight seal when conduits 52 and 136 are connected together.

A plurality of wash arms 142 extend in parallel fashion from inlet conduit 136. In general, wash arms 142 are similar to wash arms 94 of lower wash manifold 50, and include a plurality of wash nozzles 143 formed along the length of each arm 142. Of course, since fluid spray from manifold 48 is directed downwardly, the spray nozzles are formed along the bottom of each arm 142.

A resilient end cap 144 is provided for sealing the outer open end 146 of each wash arm 142. In addition, a rod 148 is connected across wash arms 142 near their outer ends by welding or the like, and serves as a means of maintaining structural integrity for manifold 48, as well as for securing the manifold within wash chamber 46, as will be described below.

A portion of the means by which upper wash manifold 48 is held within wash chamber 46 can be seen in FIG. 7. As part of the installation procedure, which will be described in detail below, manifold 48 is grasped by the operator near the outer ends 146 of wash arms 142. Inlet conduit 136 is then placed into straps 150, and its closed end 151 is placed against edge 153 of guide plate 152. Both of straps 150 and guide plate 152 are all in turn fastened to the interior surface of the wash chamber 46 of the dishwashing machine. It will be noted that manifold 48 is positioned with wash arms 142 extending downwardly from horizontal when in this near-engagement position.

Figure 8:
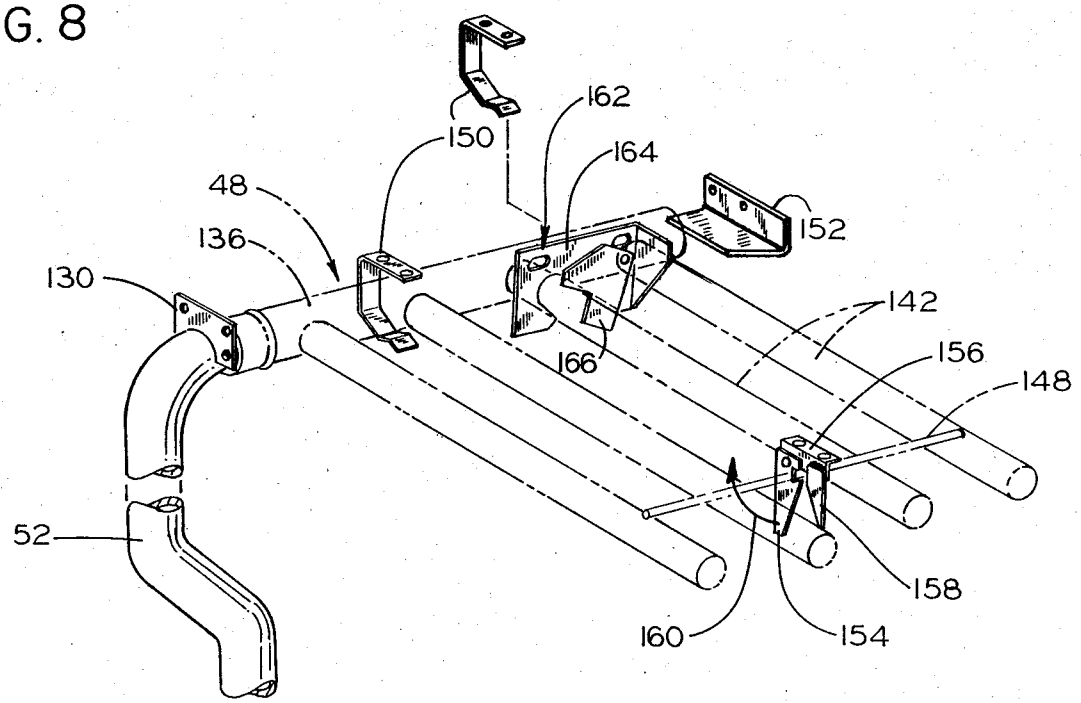
FIG. 8 is a view similar to FIG. 7, but showing the manifold connected to the supply conduit and in phantom to illustrate the supporting structure therefor.

Manifold 48 is shown in its secured, installed position in FIG. 8. Inlet conduit 136 is securely inserted into supply conduit 52 in a fluid-tight relationship. Conduit 136 continues to be held by straps 150, although lateral movement of conduit 136 resulting from insertion into supply conduit 52 moves closed end 151 away from guide plate 152.

Manifold 48 is further supported near the outer ends of wash arms 142 by engagement of rod 148 with latch 154. Latch 154 is pivotally secured to a bracket 156 which is in turn attached to the top wall of wash chamber 46. A guide 158 is either integrally formed with or fixedly attached to bracket 156. Because latch 154 is pivotally mounted, it can be moved as indicated by arrow 160 to release rod 148 during removal of manifold 48. For manifold installation, a spring return can be applied to latch 154 so that rod 148 will automatically latch when pushed up into place to hold manifold 48 in operative position. In the preferred embodiment, however latch 154 is configured to automatically latch by gravity, and no spring return is needed.

Figure 9:
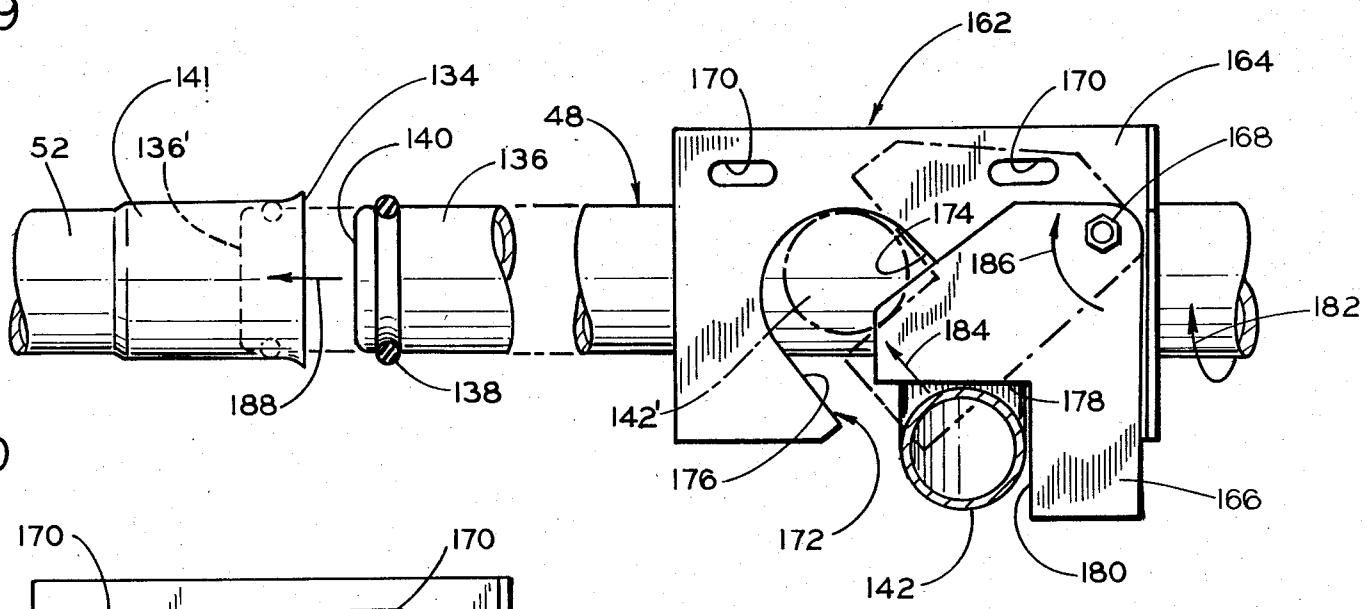
FIG. 9 is a side plan view of a portion of the upper manifold and supply conduit, illustrating the installation operation.

Also shown in FIG. 8 is a guide mechanism 162 that can be seen in detail in FIG. 9. Guide mechanism 162 includes a fixed plate 164 and a pivot plate 166 pivotally connected to fixed plate 164 by a bolt 168 or the like. Fixed plate 164 further includes a pair of openings 170 whereby plate 164 may be attached to the interior of wash chamber 46. Pivot plate 166 is provided with forward and rearward edges 178 and 180, respectively, that effectively define a notch into pivot plate 166.

Figure 10:
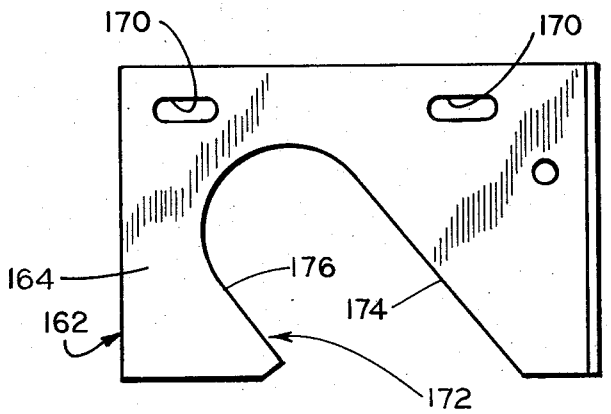
FIG. 10 is a view of a plate for guiding the upper manifold during installation.

A guide slot 172 is formed into fixed plate 164 and can be seen in detail by reference to FIG. 10. Slot 172 includes upper and lower surfaces 174 and 176, respectively, and is sufficiently wide that one wash arm 142 of manifold 48 will fit within slot 172.

Installation of manifold 48 into wash chamber 46 can be seen from FIG. 9 and by comparing FIG. 7 with FIG. 8. The operator grasps manifold 48 near the outer ends of the wash arms 142. Referring briefly to FIG. 7, manifold 48 is inserted into wash chamber 46 so that inlet conduit 136 is placed within strap 150 and is supported by support plate 152 as described. The central axis of inlet conduit 136 is therefore generally aligned with the central axis of supply conduit 52 at its open end 134. However, wash arms 142 will extend at a downward angle, so that in this embodiment, the predetermined misaligned position for manifold 48, as shown in FIG. 7, is circumferential or rotational about the central axis of inlet conduit 136. Such insertion will cause one of wash arms 142 to be postioned below guide mechanism 162, as shown by wash arm 142 in FIG. 9.

Continuing to grasp the outer ends of wash arms 142, the operator pivots the manifold 48 so as to rotate inlet conduit 136 as indicated by arrow 182 in FIG. 9. This causes wash arm 142 to come in contact with forward edge 178 of pivot plate 166. Further rotary movement of manifold 48 causes wash arm 142 to move pivot plate 166 as indicated by arrow 184. Wash arm 142 will then fit into contact with the corner defined by edges 178 and 180 of plate 166.

During continued rotation of manifold 48, contact of wash arm 142 with edges 178 and 180 causes further movement of plate 166, resulting in wash arm 142 acting as a cam follower. Arm 142 is thus moved in both an upper and lateral direction as indicated by arrow 186. Thus, inlet conduit 136 is moved by the cam action laterally in the direction indicated by arrow 188 and is forced into the open end 134 of supply conduit 52. Once wash arm 142 has reached the upper end of slot 172, as indicated by wash arm 142', inlet conduit 136 is fully inserted into supply conduit 52 as shown by conduit 136', thereby forming a fluid-tight seal.

After manifold 48 has been moved to this position, rod 148 is engaged with latch 154 (see FIG. 8) to secure manifold 48 in its installed position.

As an alternative embodiment, pivot plate 166 can be eliminated. In such a case, upper surface 174 of plate 164 serves as a cam surface and pivotal movement of manifold 48 causes wash arm 142 to move along surface 174. Lateral movement of inlet conduit 136 into supply conduit 52 is therefore effected by interaction of arm 142 and surface 174. While such sliding action may not be as smooth as the pivotal action obtained with plate 164, it does require a simpler guide mechanism 162. In either case, however, the cam action is essentially the same, and consists of moving a cam follower along a cam surface. Therefore, either embodiment is regarded as being within the scope of the present invention.

Removal of manifold 48 is essentially the reverse of the installation procedure. Rod 148 is released from latch 154, and manifold 148 is pivoted downwardly by grasping the outer ends of wash arms 142. During such movement, wash arm 142 moves along lower surface 176 of slot 172, and moves pivot plate 166 by contact with rearward edge 180. During such movement, the forward edge 178 of plate 166 aids in moving wash arm 142 along lower surface 176. Due to the cam action caused by the lateral component of the movement of wash arm 142 along surface 176, inlet conduit 136 is pulled from within supply conduit 52, thereby disconnecting manifold 48. Once wash arm 142 has been moved clear of guide means 162, the operator can remove inlet conduit 136 from strap 150 and support plate 152. Manifold 48 is then taken out of wash chamber 46.

Thus, as with lower wash manifold 50, upper wash manifold 48 can be installed and removed from within the dishwashing machine without the need for the operator to reach across the machine to connect manifold 48 with the supply conduit 52. Thus, removal and installation of manifold 48 is greatly facilitated, and at the same time, a fluid-tight connection is assured.

While the forms of apparatus disclosed herein constitute preferred embodiments of this invention, it is to be understood that the invention is not limited to these precise forms of apparatus, and that changes may be made therein without departing from the scope of the invention which is defined in the appended claims.

What is claimed is:

1. A spray system for forming directed streams of a liquid supplied under pressure from a liquid source, comprising:

a supply conduit connected with said source and terminating at a first open end and having a first central axis thereat;

a manifold communicating with a plurality of spray nozzles and having an inlet conduit terminating at a second open end and having a second central axis thereat;

said supply and inlet conduits cooperating for coupling said second open end of said inlet conduit with said first open end of said supply conduit;

sealing means carried at at least one of said open ends for providing a fluid-tight seal upon proper alignment and full engagement of said inlet conduit with said supply conduit;

supporting means fixedly mounted with respect to said supply conduit for supporting said inlet conduit for pivotal rotation thereof about said second central axis;

said inlet conduit and said supporting means cooperating such that movement of said manifold toward said supply conduit to position said second open end of said inlet conduit near, although not in contact with, said first open end with said inlet conduit in a predetermined but misaligned rotational position with respect to said supply conduit, said first and second central axes being colinear, causes said inlet conduit and said supporting means to engage for defining a pivot about which said inlet conduit may be moved by pivotal motion into rotational alignment with said supply conduit; and means for converting said rotational pivotal motion of said inlet conduit into motion of said second open end substantially along said first central axis sufficient to move said second open end into contact and fluid-tight engagement with said first open end;

said pivotal converting means including first and second means;

said first means defining first and second cam surfaces;

said second means defining a cam follower for cooperation with said cam surfaces;

one of said first and second means being fixedly mounted with respect to said supply conduit, and the other of said first and second means being fixedly mounted with respect to said inlet conduit; and said first and second means defining said cam surfaces and said cam follower such that upon positioning of said inlet conduit in said predetermined but misaligned rotational position, said cam follower is positioned adjacent said first cam surface such that pivotal movement of said inlet conduit in a first direction causes movement of said cam follower along said first cam surface and produces linear movement of said inlet conduit along said second axis toward said first open end to engage said first and second open ends.

2. The spray system as defined in claim 1, wherein said first and second means further define said cam surfaces and said cam follower such that upon full coupling of said second open end with said first open end, rotation of said inlet conduit about said second central axis in a second, opposite direction causes movement of said cam follower along said second cam surface to produce linear movement of said inlet conduit along said second axis to move said second open end out of engagement with said first open end.

3. The spray system as defined in claim 2, wherein said first means includes a plate having a slot with opposing side edges formed therein, said side edges defining said first and second cam surfaces.

4. The spray system as defined in claim 3, wherein said manifold further includes a spray arm extending substantially perpendicularly from said inlet conduit and having said spray nozzles formed thereon, said spray arm being of a diameter such that said arm is fittable within said slot, and wherein said second means includes said spray arm for defining said cam follower.

5. The spray system as defined in claim 2, wherein said first means includes a fixed plate mounted in fixed relationship to said supply conduit and a pivot plate pivotally attached to said fixed plate, said pivot plate defining an engagement portion thereof for engagement with said cam follower upon positioning said cam follower adjacent said engagement portion, said engagement portion defining said first cam surface such that movement of said cam follower causes pivotal movement of said pivot plate to produce linear movement of said inlet conduit.

6. The spray system as defined in claim 5, wherein said manifold further includes a spray arm extending substantially perpedicularly from said inlet conduit and having said spray nozzles formed thereon, said pivot plate defines a notch therein as said engagement portion, and said second means includes said spray arm for defining said cam follower, said spray arm being fittable within said notch.

7. The spray system as defined in claim 6, wherein said fixed plate defines a slot having opposing first and second side edges and of a width greater than the diameter of said spray arm formed therein, said pivot plate being pivotally attached to said fixed plate such that pivotal movement of said spray arm therewith is generally along said first edge, and wherein said second edge defines said second cam surface.

8. The spray system as defined in claim 1, further comprising means for releasably securing said manifold after full coupling of said inlet conduit with said supply conduit.

* * * * *